US008079686B2

(12) United States Patent
Shimoda

(10) Patent No.: US 8,079,686 B2
(45) Date of Patent: Dec. 20, 2011

(54) LIQUID STORAGE CONTAINER AND RECORDING APPARATUS

(75) Inventor: Junji Shimoda, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 809 days.

(21) Appl. No.: 12/065,726

(22) PCT Filed: Nov. 14, 2006

(86) PCT No.: PCT/JP2006/323057

§ 371 (c)(1),
(2), (4) Date: Mar. 4, 2008

(87) PCT Pub. No.: WO2007/058334

PCT Pub. Date: May 24, 2007

(65) Prior Publication Data

US 2009/0135236 A1 May 28, 2009

(30) Foreign Application Priority Data

Nov. 15, 2005 (JP) ..... 2005-330644

(51) Int. Cl.
*B41J 2/175* (2006.01)

(52) U.S. Cl. ..... 347/86; 347/84

(58) Field of Classification Search ..... None
See application file for complete search history.

(56) References Cited

U.S. PATENT DOCUMENTS

| | | | | |
|---|---|---|---|---|
| 4,847,637 | A | 7/1989 | Watanabe et al. | 346/140 R |
| 4,980,699 | A | 12/1990 | Tanabe et al. | 346/1.1 |
| 5,264,865 | A | 11/1993 | Shimoda et al. | 346/1.1 |
| 5,479,193 | A | 12/1995 | Shimoda et al. | 347/7 |
| 5,504,512 | A | 4/1996 | Shimoda et al. | 347/86 |
| 5,552,815 | A | 9/1996 | Shimoda | 347/85 |
| 5,997,121 | A * | 12/1999 | Altfather et al. | 347/7 |
| 6,010,201 | A | 1/2000 | Shimoda | 347/7 |
| 7,014,306 | B2 | 3/2006 | Netsu et al. | 347/86 |
| 2001/0012026 | A1 | 8/2001 | Kobayashi et al. | 347/19 |
| 2005/0024454 | A1 | 2/2005 | Hayamizu et al. | 347/86 |
| 2005/0231572 | A1 | 10/2005 | Suzuki et al. | 347/87 |
| 2005/0270344 | A1 | 12/2005 | Tsujimoto et al. | 347/86 |

FOREIGN PATENT DOCUMENTS

| | | |
|---|---|---|
| JP | 10-230616 | 9/1998 |
| JP | 10-315500 | 12/1998 |
| JP | 2002-52698 | 2/2002 |
| JP | 2003-112430 | 4/2003 |
| JP | 2003-266656 | 9/2003 |
| JP | 2005-22356 | 1/2005 |

OTHER PUBLICATIONS

Taiwanese Office Action dated Mar. 16, 2009, from corresponding Taiwanese Application No. 095142254, and English language translation thereof.

* cited by examiner

*Primary Examiner* — Matthew Luu
*Assistant Examiner* — Erica Lin
(74) *Attorney, Agent, or Firm* — Fitzpatrick, Cella, Harper & Scinto

(57) ABSTRACT

A liquid container detachably mountable to a recording apparatus, wherein the recording apparatus includes a feeding passage for feeding a recording material, a carriage for scanningly moving a recording head in a direction crossing with a feeding direction of the recording material, and a mounting portion to which the liquid container is mountable, the liquid container includes light reflection means capable of reflecting light from a light emitting portion of the recording apparatus to a first light receiving portion provided in the carriage and to a second light receiving portion provided in a feeding passage of recording material.

8 Claims, 13 Drawing Sheets

(a)

(b)

LIQUID STORAGE CONTAINER AND RECORDING APPARATUS

TECHNICAL FIELD

The present invention relates to a recording apparatus which records on recording medium by jetting liquid, and a liquid storage container removably mountable in a recording apparatus.

In particular, the present invention relates to an ink container in which ink is stored, and an ink jet recording apparatus.

BACKGROUND ART

There have been proposed various recording apparatuses for recording on recording medium such as paper, fabric, plastic sheet, OHP sheet, or the like. As for the methods employed by these recording apparatuses, the wire-dot method, thermal recording method, thermal transfer method, ink jet method, etc., have been proposed.

Among the abovementioned recording methods, the ink jet recording method which records on recording medium by jetting ink from nozzles disposed on a recording element makes it possible to form an image at a high level of density. It also makes it possible to record at a high speed while keeping the apparatus very low in noise. Further, an ink jet recording apparatus is advantageous in that it is low in operational cost, can be reduced in size, and can be used for recording in color with the use of multiple inks different in color.

For the reasons given above, an ink jet recording apparatus is used as an outputting means, that is, output terminal, for an information system, for example, a copying machine, a facsimile machine, an electronic typewriter, a word processor, a workstation, etc. Further, it is used as a portable printer for a personal computer, an optical disc apparatus, a video apparatus, etc. In other words, an ink jet recording apparatus can be modified in structure to accommodate the unique functions and usages of a system with which it is used.

Generally, an ink jet recording apparatus of the serial type is provided with: an ink jet recording head; a carriage on which the recording head is mounted; an ink container for supplying the recording head with ink; a conveying means for conveying recording medium; and a controlling means for controlling the preceding components. As for the types of ink jet recording head, there have been known those which use an electro-mechanical transducer element, such as a piezoelectric element, as the element for generating the energy for jetting ink, those which use an electro-thermal transducer element as the element for generating the energy for jetting ink, etc. Among those types of ink jet recording head, those which employ an electro-thermal transducer element are advantageous in that they are higher in the density at which nozzles can be disposed, are easier to reduce in size, and are lower in manufacturing cost.

When an ink jet recording apparatus of the serial type actually records on recording medium, it moves its recording head in the primary scan direction in a manner to scan the recording medium while jetting ink droplets from its nozzles. Further, it intermittently moves (conveys) the recording medium; it moves the recording medium in the direction perpendicular to the primary scan direction, by a distance equal to the recording width (at a preset pitch), when it is not actually recording. The recording head is provided with a large number of nozzles for jetting ink, which are arranged in the secondary scan direction. Thus, each time the recording head is moved in a manner to scan the recording medium in the primary direction, a part of an image, the width (in terms of secondary scan direction) of which corresponds to the nozzles count, is recorded.

An ink jet recording apparatus capable of recording in color employs multiple recording heads, which are different in the color of the ink they jet. Each recording head is connected to its own ink container, which contains the ink, the color of which matches the color to which the recording head is assigned. The ink containers, which are for supplying the corresponding recording heads with ink, are removably mountable in the main assembly of an image forming apparatus; each ink container is replaceable with a new one if it runs out of the ink therein. There are various ink containers; there have been known those which are made up of a pouch in which ink is stored, a connective portion for connecting an ink container with the main assembly of a recording apparatus, and a shell in which the pouch is disposed, those which are made up of a shell in which ink is directly stored, a connective portion attached to the shell, an air vent for allowing external air to enter the shell as the ink therein is consumed, and the like.

It is one of the extremely important matters for an ink jet recording apparatus that a correct ink container is properly mounted in the ink recording apparatus. That is, for the purpose of ensuring that an ink jet recording apparatus normally operates, it is extremely important that the ink in an ink container matches in color the ink which is to be jetted from a recording head to which the ink container is to be connected, and the connective portion of the ink container is properly connected to the ink receiving opening of the main assembly of the recording apparatus.

For the purpose of ensuring that an ink jet recording apparatus can be normally operated to obtain an excellent recorded image, it is also an extremely important matters that recording medium is accurately conveyed onto a platen in an ink jet recording apparatus, and the recording medium conveyance speed and recording medium conveyance direction in the recording apparatus are accurately controlled. That is, it is possible that recording medium is conveyed askew in an ink jet recording apparatus. If recording medium is conveyed askew in an ink jet recording apparatus, an image is recorded askew relative to the recording medium, and moreover, it is possible that the recording medium is caught, failing to be conveyed further, while it is conveyed onto, or moved on, platen; it is possible that paper jam, which has extremely adverse effects on the entirety of the apparatus, might occur. Therefore, in the field of an ink jet recording apparatus, it is desired to realize a compact ink jet recording apparatus which is low in cost, and yet, is capable of satisfying the above described requirements.

Japanese Laid-open Patent Application 10-230616 discloses an apparatus which uses an optical sensor to detect both the amount of ink remaining in an ink container and whether or not the ink container is present in the apparatus.

Japanese Laid-open Patent Application 2003-112430 discloses an ink jet recording apparatus, the main assembly of which is provided with a light emitting element for detecting whether or not an ink container is present in the apparatus, or whether or not the ink container is in the proper position in the apparatus.

Japanese Laid-open Patent Application 2003-266656 discloses an apparatus which optically detect the amount of the ink remaining in an ink container and is provided with a light emitting element which detects the type of the recording paper being conveyed, by illuminating the recording paper while the carriage is outside the area in which an ink container is mounted on the carriage.

However, the abovementioned ink jet recording apparatuses in accordance with the prior arts are not structured to simultaneously carry out the process of optically detecting the presence or absence of an ink container, the state of an ink container, or the like information regarding an ink container, and the process of detecting the state in which printing paper is being conveyed.

DISCLOSURE OF THE INVENTION

The primary object of the present invention is to provide an ink jet recording apparatus and an ink container, which are low in cost and simple in structure, and yet, are capable of detecting the occurrences of an error in the mounting of an ink container, an error in the recording medium conveyance, and the like.

According to an aspect of the present invention, there is provided a liquid container detachably mountable to a recording apparatus, wherein said recording apparatus includes a feeding passage for feeding a recording material, a carriage for scanningly moving a recording head in a direction crossing with a feeding direction of the recording material, and a mounting portion to which said liquid container is mountable, said liquid container comprising light reflection means capable of reflecting light from a light emitting portion of the recording apparatus to a first light receiving portion provided in the carriage and to a second light receiving portion provided in a feeding passage of recording material.

In said liquid container, said light reflection means may be disposed on an end surface with respect to a mounting direction in which said liquid container is mounted to the recording apparatus, and said light reflection means may include a first reflecting surface for reflecting the light toward the first light receiving portion and a second reflecting surface for reflecting the light toward the second light receiving portion.

In said liquid container, said light reflection means may include a plurality of such first reflecting surfaces and a plurality of such second reflecting surfaces, wherein the first reflecting surfaces and the second reflecting surfaces may be arranged alternately.

In said liquid container, said light reflection means may include a plurality of such first reflecting surfaces and a plurality of such second reflecting surfaces, wherein the first reflecting surfaces and the second reflecting surfaces may be arranged alternately and continuously.

In said liquid container, said light reflection means may be movable between a position for reflecting the light toward the first light receiving portion and a position for reflecting the light toward the second light receiving portion.

In said liquid container, said light reflection means may be disposed at a position peculiar to a kind of liquid contained in said liquid container.

According to another aspect of the present invention, there is provided a recording apparatus comprising a feeding passage for feeding a recording material; a carriage for scanningly moving a recording head in a direction crossing with a feeding direction of the recording material; a mounting portion to which said liquid container is mountable; a light emitting portion for emitting light toward said mounting portion; a first light receiving portion for receiving the light reflected by a light reflection means provided on the liquid container mounted to said mounting portion; a second light receiving portion, provided in said feeding passage, for receiving the light reflected by the light reflection means; and discriminating means for discriminating a mounting state of the liquid container in accordance with an output signal of said first light receiving portion and for discriminating a feeding state of the recording material in accordance with an output signal of said second light receiving portion.

In said apparatus, said apparatus may comprise a plurality of such mounting portions to each of which the liquid container is detachably mountable and a plurality of such second light receiving portions corresponding to a plurality of such recording heads, wherein said light emitting portion may emit the light toward said mounting portions.

In said apparatus, said discriminating means may discriminate the mounting states of the liquid containers at said mounting portions in accordance with the output signal of said first light receiving portion.

In said apparatus, said discriminating means may discriminate whether or not the liquid containers are mounted properly to respective mounting portions, in accordance with the output signals of said first light receiving portion and said second light receiving portion.

In said apparatus, said mounting portions may be arranged in the scanning direction of said carriage, and said discriminating means may discriminate a mounting portion to which the liquid container is not mounted, on the basis of an output signal of said first light receiving portion and positional information of said carriage with respect to the scanning direction of said carriage.

In said apparatus, said light reflection means may be disposed at a position peculiar to a kind of liquid contained in said liquid container, wherein said mounting portions may be arranged in the scanning direction of said carriage, and said discriminating means may discriminate a mounting portion to which the liquid container is not mounted and a kind of ink in a mounted one of the liquid containers, on the basis of an output signal of said first light receiving portion and positional information of said carriage with respect to the scanning direction of said carriage.

In said apparatus, said discriminating means may discriminate a feeding state of the recording material on the basis of time periods from start of recording material feeding operation to outputs of non-light-receiving signals of said second light receiving portions.

According to the present invention, the light from a light emitting portion with which a carriage is provided is reflected to a first light receiving portion with which the carriage is provided, and a light receiving portion located in the recording medium conveyance path. Therefore, only one light emitting portion is required to detect the state of ink container in the ink jet recording apparatus, and the state in which recording medium is being conveyed in the apparatus. Further, one type of light reflecting member can be used for all the ink container different in the color of the ink stored therein, making it possible to realize an ink container substantially smaller in overall size than an ink container having multiple light reflecting members. Therefore, it is possible to reduce an ink jet recording apparatus in overall size.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3(*b*) is a plan view of a recording medium, which is being conveyed askew, and the portions of the ink jet recording apparatus related to the first embodiment.

FIG. 4(*b*) is a perspective view of the reflective surface of the light reflecting member.

FIG. 6(*b*) is also a perspective of the ink container for yellow ink in the second embodiment.

FIG. 6(*c*) is a perspective view of the ink container for magenta ink in the second embodiment.

FIG. 6(*d*) is a perspective view of the ink container for cyan ink in the second embodiment.

FIG. 9(*b*) is a schematic drawing showing the second light path in the fourth embodiment of the present invention.

FIG. 10(*b*) is a perspective view of the ink container in the fourth embodiment mounted in the proper position.

FIG. 12(*b*) is a perspective view of the ink container for yellow ink in the fourth embodiment.

FIG. 12(*c*) is a perspective view of the ink container for magenta ink in the fourth embodiment.

FIG. 12(*d*) is a perspective view of the ink container for cyan ink in the fourth embodiment.

FIG. 13(*b*) is a perspective view of the ink container, in the fifth embodiment of the present invention, the light reflecting member of which has moved in the direction Y1.

BEST MODE FOR CARRYING OUT THE INVENTION

Next, the preferred embodiments of the present invention will be described.

Embodiment 1

Figure 1:
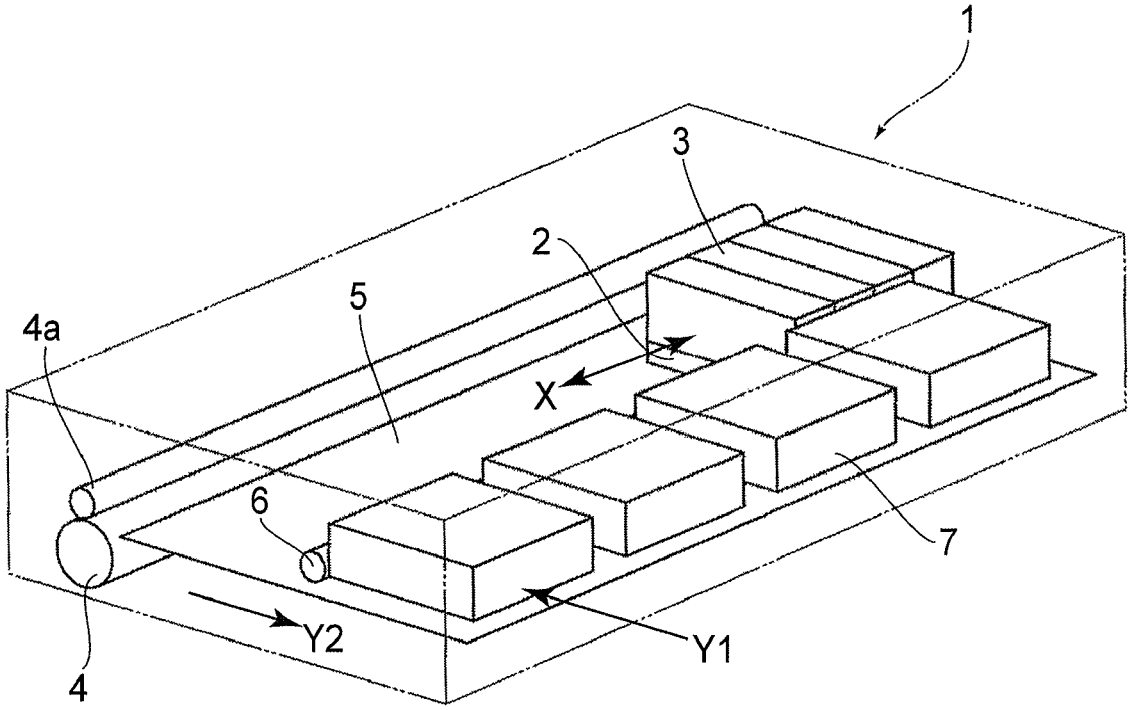
FIG. 1 is a perspective phantom view f the ink jet apparatus in the first embodiment of the present invention, showing the internal structure thereof.

FIG. 1 is a schematic perspective phantom view of the ink jet apparatus in the first embodiment of the present invention, showing the internal structure thereof. Designated by a referential symbol 1 is an ink jet recording apparatus of the serial type. The ink jet recording apparatus 1 has: a recording head 2 which jets ink; a head moving means for moving the recording head in the primary scan direction (direction X) in a manner to scan recording medium while the recording head 2 is jetting ink; a conveying means for conveying recording medium in the direction (direction Y) perpendicular to the primary scan direction; and a platen 5 which supports recording medium from below.

The head moving means is made up of a carriage 3 which reciprocally moves in the primary scan direction while holding the recording head 2. The carriage 3 is reciprocally moved in the primary scan direction by the driving force from an unshown motor. On the carriage 3, multiple (four in this embodiment) recording heads 2 are held, which jet four different inks, one for one. Each recording head 2 has multiple nozzles, and is positioned so that the surface of the recording head 2, at which the multiple nozzles open, faces recording medium. The recording head 2 also has multiple liquid passages which lead to the corresponding nozzles. In each of the liquid passages, an element for generating ink jetting energy is disposed.

As for the conveying means, it has a conveyance roller 4 and a pinch roller 4*a*. The conveyance roller 4 is disposed on the upstream side of the recording head 2, in terms of the recording medium conveyance direction. The pinch roller 4*a* is kept pressed upon the conveyance roller 4. The conveying means also has a paper discharging roller 6, which is disposed on the downstream side of the recording head 2, in terms of the recording medium conveyance direction, and is kept pressed upon the abovementioned platen 5. The paper discharging roller 6, which is kept upon the platen 5, is rotated in coordination with the rotation of the conveyance roller 4 while remaining pressed upon the recording medium on which an image has just been recorded by the recording head 2. As the paper discharging roller 6 is rotated, the recording medium is discharged into a delivery area (unshown), which is on the front side of the ink jet recording apparatus.

Designated by a referential symbol 7 is an ink containers. The ink jet recording apparatus has multiple ink containers 7, which correspond to the plural recording heads 2, in terms of their count and the ink color. The ink container 7 is structured so that it can be removably attachable to the recording apparatus 1. As for the structure of the ink container 7, the ink container 7 may be made up of a boxy shell in which ink is directly stored, or it may be made up of a boxy shell and an ink storage pouch placed in the boxy shell. The front side of the ink jet recording apparatus 1 is provided with an ink container bay (unshown) having plural openings, through which the ink containers 7 are mounted into the ink container bay. As for the mounting of the ink containers 7, each ink container 7 is to be inserted (in the direction indicated by arrow mark Y) into a preset position in the apparatus, through the corresponding opening of the ink container bay. As for the extraction of the ink containers 7, each ink container 7 is to be pulled out through the corresponding opening of the ink container bay.

The boxy shell of each ink container 7 is provided with an ink storage space, in which ink is stored. The ink storage space is connected to a connective spout 13 (FIG. 4(*a*)), which projects from the downstream end wall of the boxy shell, in terms of the ink container insertion direction. The ink storage space is the internal space itself of the boxy shell, or the internal space of the ink pouch placed in the boxy shell. The spout 13 becomes mechanically connected to the ink jet recording apparatus during the mounting of the ink container 7 into the ink jet recording apparatus. The ink container 7 supplies the corresponding recording head 2 of the ink jet recording apparatus 1 through the spout 13. As for the connection between the spout 13 and ink jet recording apparatus, the ink container 7 and ink jet recording apparatus are structured so that the spout 13 is connected to an unshown tube, which is connected to the recording head 2 on the carriage, or so that the spout 13 is connected to a tube connected to a secondary ink container, and the ink from the ink container 7 is supplied to the recording head from the secondary ink container. Further, they may be structured so that the spout 13 is connected to the recording head or subordinate ink container on the carriage only when the ink is to be supplied; they may be structured so that the ink is intermittently supplied.

The recording operation by the above described recording apparatus is as follows: (1) recording medium is intermittently conveyed by the rotation of the conveyance roller 4 and paper discharge roller 6; (2) while the recording medium is stationary during the intermittent conveyance of the recording medium, (3) ink is jetted from the recording head onto the recording medium while moving the carriage 3. As the recording head is moved in the primary scan direction from a given point to another point, a part of an image is recorded on the recording medium. The width of this portion of the image, in terms of the direction in which the abovementioned nozzles are aligned, equals the length of the line which the nozzles form. The recording medium is intermittently conveyed, and the interval by which it is moved is equal to the recording width in terms of the recording medium conveyance direction. The operation for moving the recording head in the primary scan direction and the operation for conveying of the recording medium are alternately repeated to form an intended image on the recording medium.

The accuracy in the recording medium conveyance direction and the accuracy in the recording medium conveyance speed, in addition to the accuracy with which ink is jetted from the head 2 or accuracy in the direction in which ink is jetted, have significant effects on the quality of the image which an ink jet recording apparatus of the serial type, such as the above described one, forms Further, if the ink container 7 fails to be inserted into its proper position in the recording apparatus, the spout 13 fails to be properly connected to the ink receiving opening in the recording apparatus, preventing ink from properly supplied to the recording apparatus and/or allowing ink to leak. Further, it is very important that each ink container 7 is mounted into the recording apparatus, with no mounting error, so that the ink stored in the ink container 7 matches the ink ejected by the recording head to which the ink container 7 is connected.

Figure 2:
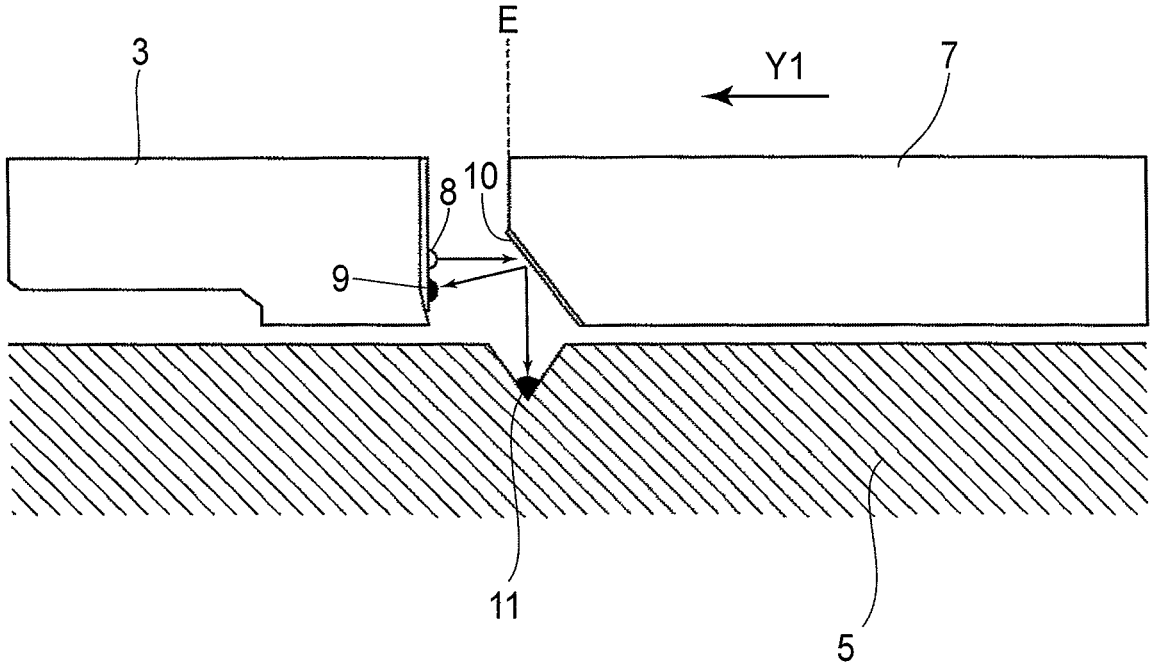
FIG. 2 is a sectional view of the ink container, carriage, and platen in the first embodiment, showing the positional relationship thereof.

The ink jet recording apparatus in the first embodiment is structured as shown in FIGS. 2-6. FIG. 2 is a schematic sectional view of the ink container 7, platen 5, and carriage 3 of the ink jet recording apparatus 1, showing their positional relationship after the mounting of the ink container 7 into the ink jet recording apparatus. Referring to FIG. 2, on the surface of the carriage 3, which is facing the ink container 7, is provided with a light emitting portion 8 and a light sensor 9 (first light receiving portion), and the platen 5 is provided with a light sensor 11 (second light receiving portion). The surface of the ink container 7, which is facing the carriage 3, is provided with a light reflecting member 10, which has the function of reflecting the light from the light emitting portion 8 to guide the light to the light sensor 9, and also, the function of reflecting the light from the light emitting portion 8 to guide the light to the light sensor 11 in the platen 5. Incidentally, each ink container 7 is provided with the light reflecting member 10.

Figure 4:
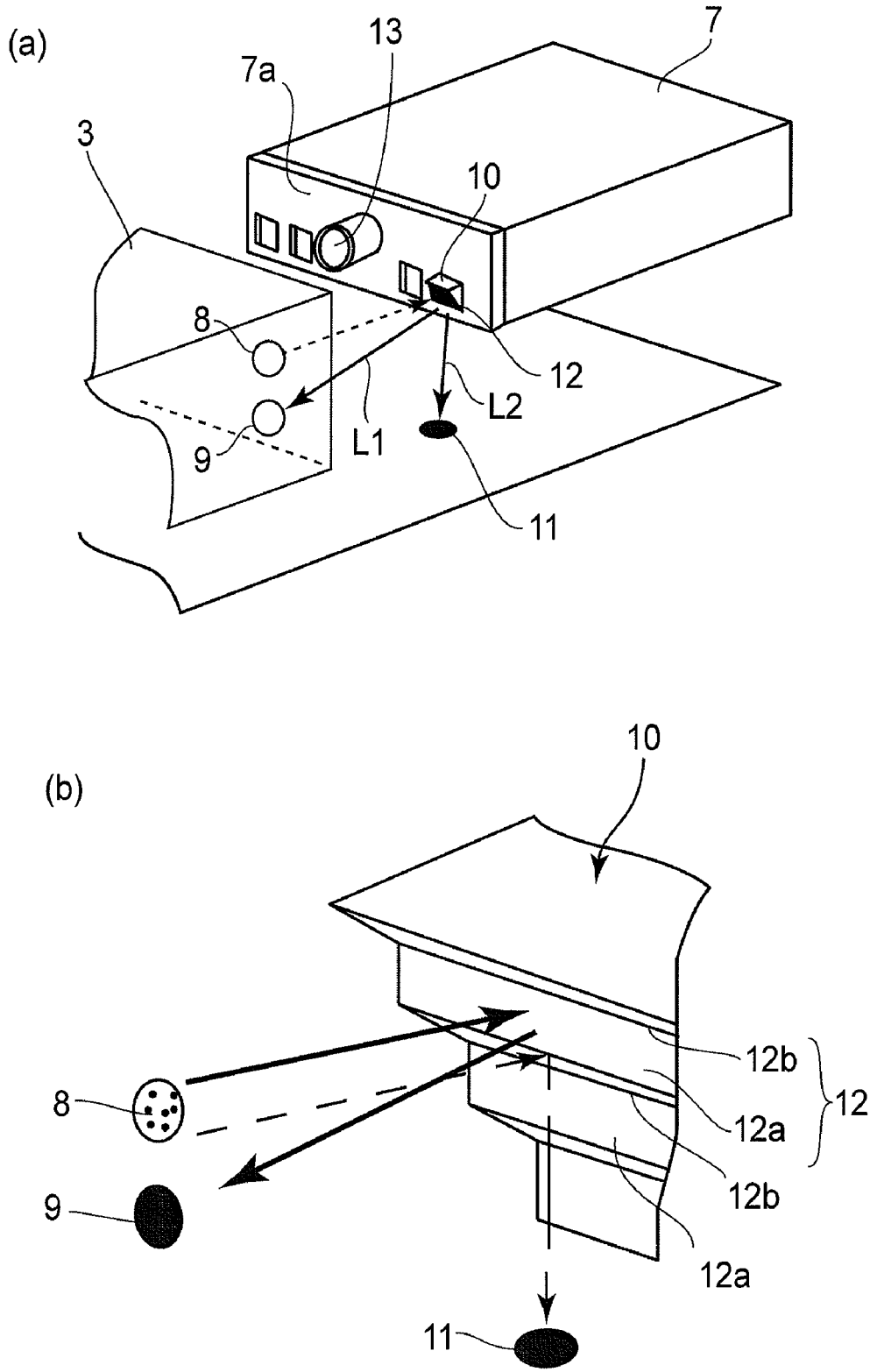
FIG. 4(*a*) is a perspective view of the ink container and its adjacencies in the first embodiment, showing the structure and functions of the light reflecting member.

FIG. 4 is a drawing which concretely shows the structure and functions of the light reflecting portion 8; FIG. 4(*a*) is a perspective view of the light reflecting portion 8, and FIG. 4(*b*) is a perspective view of the reflective surface of the light reflecting member 10, showing its shape.

Referring to FIG. 4(*a*), the light reflecting member 10 is solidly attached to the surface 7*a* of the ink container 7, which faces the carriage 3. Referring to FIG. 4(*a*), the reflective surface 12 of the light reflecting member 10 is made up of multiple first reflective sections 12*a*, which are vertical, and multiple second reflective sections, which are angled. The first and second reflective sections 12*a* and 12*b* (which hereafter will be referred to as first and second reflective surfaces 12*a* and 12*b*, respectively) are alternately positioned, rendering the reflective surface 12 stair-stepped. As light is projected from the single light emitting portion 8 of the carriage 3 onto the ink container 7, the light hits the first and second reflective surfaces 12*a* and 12*b*. The angle (incident angle) at which the light hits the first reflective surface 12*a* is different from the angle (incident angle) at which the light hits the second reflective surface. Referring to FIG. 4(*b*), the light incident to the first reflective surface 12*a* and the light reflected by the first reflective surface 12*a* are represented by bold lines, whereas the light incident to the second reflective surface 12*b* and the light reflected by the second reflective surface 12*b* are represented by dotted lines. The direction in which the light from the light emitting portion 8 is reflected by the first reflective surface 12*a* is different from the direction in which the light from the light emitting portion 8 is reflected by the second reflective surface 12*b*. When the ink container 7 is in the proper position in the apparatus, the light emitted from the light emitting portion 8 of the carriage 3 toward the first reflective surface 12 follows a first light path L1 (FIG. 4(*a*)) and enters the light sensor 9. At the same time, the light reflected by the second reflective surface 12*b* follows a second light path L2 (FIG. 4(*a*)) and enters the light sensor 11.

The light reflecting member 10 structured as described above is one of the examples of the light reflecting member in accordance with the present invention. As another example of the light reflecting member in accordance with the present invention, the functions similar to those of the above described light reflecting reflective member can be realized with the use of a so-called half-mirror, which is a semitransparent (semireflective) mirror. Further, as long as the first and second reflective surfaces are alternately positioned, they may be continuous positioned, or multiple sets of the first reflective surface and second reflective surface may be positioned with preset intervals.

The state (attitude, position, etc.) of each ink container 7 in the recording apparatus structured as described above can be detected by moving the carriage 3 in the primary scan direction while driving the light emitting portion 8. That is, when the ink container 7 is in the proper position in the ink container bay of the recording apparatus, the light emitted from the light emitting portion 8 of the carriage 3 sequentially hits each of the light reflecting members 10 on the end surfaces 7*a* of the ink containers 7.

In other words, as the carriage 3 is moved in the primary scan direction, the light emitting portion 8 passes by each ink container 7, and the light from the light emitting portion 8 is reflected by the light reflecting member 10 and reaches the light sensor 9 following the first light path L1, and as the light sensor 9 receives the light, it outputs a signal (light reception signal (for example, ON signal)) to the recording apparatus. In the first embodiment, in which the recording apparatus employs four ink containers different in the color of the ink stored therein, the light reception signal is outputted four times from the light sensor 9. In comparison, when there is no ink container 7 in the ink container bay, the light from the light emitting portion 8 is not reflected into the above described first light path L1, even if the carriage 3 passes by the ink container bay. Thus, a signal (no-light-reception signal (OFF signal)), which is different from the signal outputted by the light sensor 9 when the light sensor 9 receives the light, is outputted from the light sensor 9. Thus, which ink container 7 is not in the recording apparatus can be determined based on the signal outputted by the light sensor 9 and the confirmation of the carriage position. Incidentally, the information regarding the position of the carriage 3 in terms of the primary scan direction can be obtained with the use of one of the well-known encoders, which outputs pulses as the carriage 3 is moved; the information can be obtained by counting the number of pulses outputted while the carriage 3 is moved from a preset referential point to a specific point.

Figure 3:
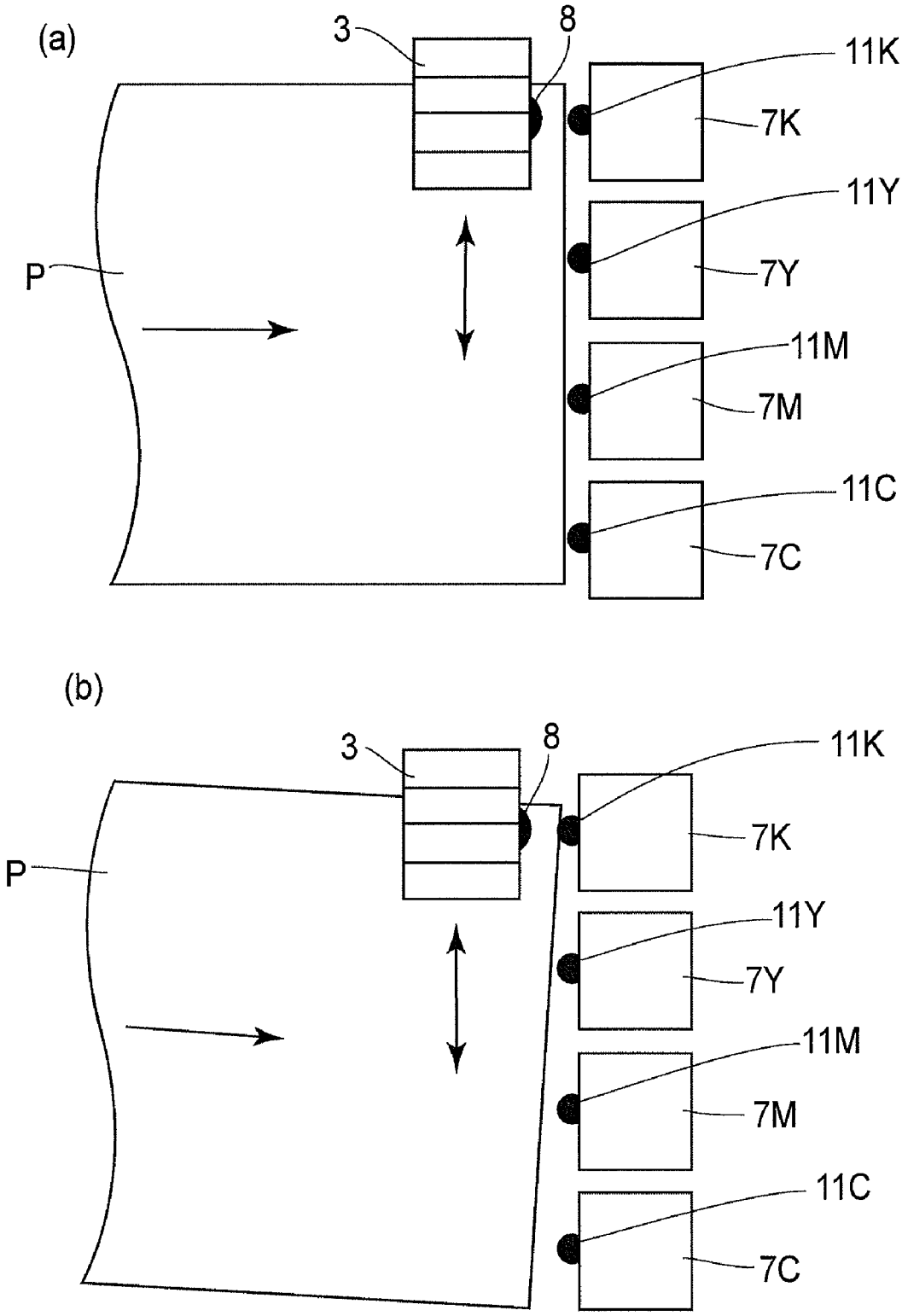
FIG. 3(*a*) is a plan view of a recording medium, which is being properly conveyed, and the portions of the ink jet recording apparatus related to the first embodiment.

In the first embodiment, when no recording medium is on the platen 5, whether or not each ink container 7 is in the proper position in the ink container bay (whether or not the leading end of each ink container is at a point indicated by a referential symbol E in FIG. 2) can also be determined by moving the carriage 3 in the primary scan direction. That is, when the ink containers 7 are in their proper positions in the ink container bay of the ink jet recording apparatus 1, that is, when the leading end of each ink container 7 is at the point E, the light emitted from the light emitting portion 8 sequentially hits the light reflecting members 10 of the ink containers 7, being thereby reflected by the light reflecting members 10, as the carriage 8 is moved in the primary scan direction. The light reflected by each light reflecting member 10 enters the light sensor 11 with which the platen 5 is provided. Referring to FIG. 3, the platen 5 is provided with multiple light sensors 11, which correspond in position to the properly positioned ink containers 7 in the ink container bay, one for one. Thus, as the carriage 3 passes by the end surface of any of the ink containers 7, the light follows the second light path L2, and a signal (reception signal) is outputted from the corresponding light sensor 11 in response to the reception of the light.

On the other hand, if the state (position, attitude, etc.) of any of the ink containers 7 in the ink container bay is unsatisfactory, the light reflected by the second reflective surface 12*b* of the light reflecting member 10 does not enter the light sensor 11. Thus, the signal outputted from the light sensor 11 in this situation is a signal (no-light-reception signal), which is different from the signal outputted when the light sensor 11 receives the reflected light. Therefore, which ink container 7 in the ink container bay is in the unsatisfactory state can be determined based on the signal from the light sensor 11 and the information regarding the position of the carriage 3.

Incidentally, in this first embodiment, an operation, such as the above described one, for detecting the state (position, attitude, etc.) of the ink container 7 in the recording apparatus may be carried out any time when the carriage 3 can be moved in the primary scan direction. In other words, it may be carried out with various timing; it may be carried out, for example, right after the power to the recording apparatus is turned on; during the replacement of an ink container (ink containers); immediately before the starting of a recording operation or the restarting of the recording operation; when starting again to move the carriage 3 in the primary scan direction after the carriage 3 is stopped; or the like timing.

Further, in this embodiment, not only can the state of the ink containers 7 in the recording apparatus be detected as described above, but also, the errors in recording medium conveyance can be detected by moving the carriage 3 in the primary scan direction while driving the light emitting portion 8.

FIG. 3 is a plan view of a recording medium and the portions of the ink jet recording apparatus related to this embodiment, showing the method for detecting the state in which the recording medium is being conveyed; FIG. 3(*a*) shows the recording medium which is being properly conveyed, and FIG. 3(*b*) shows the recording medium which is being conveyed askew.

When there is no recording medium on the platen 5, and the ink containers 7 are in their proper positions in the recording apparatus, as the carriage 3 is moved in the primary scan direction as described above, the light from the light emitting portion 8 is reflected by the light reflecting member 10 and reaches the light sensor 11 through the second light path L2. As a result, a light reception signal is outputted from the light sensor 11. A recording start signal is inputted into the recording apparatus when the ink containers 7 are in this state. As the recording start signal is inputted, the recording medium P is pinched by the conveyance roller 4 and pinch roller 4 as shown in FIG. 1, and is continuously moved on the platen 5. More specifically, the rotation of the conveyance roller 4 is started in coordination with the delivery of the recording medium P to the interface between the two rollers 4 and 4*a*, causing the recording medium P pinched between the pinch roller 4*a* and conveyance roller 4 to be conveyed on the platen 5.

Thus, whether or not the leading edge of the recording paper has reached a preset point in the recording apparatus can be determined by detecting the timing with which the conveyance roller and pinch roller begin to be driven.

Thereafter, as the leading edge of the recording medium P reaches the recording start point, that is, the point at which it faces the ink jet recording head 2 for the first time, the operation for conveying the recording medium P is interrupted, and the operation for moving the carriage 3 in the primary scan direction while jetting ink from the recording head according to the data for recording is started. At this point in time, the leading edge of the recording medium P has not reached below the theoretical line in which to the light sensors 11 in the platen 5 are aligned. Therefore, the light emitted from the light emitting portion 8 of the carriage 3 is received by the light sensors 11 in the platen 5 after travelling by way of the corresponding light reflecting members 10. As a result, the light reception signal is outputted from each light sensor 11.

Next, the operation for recording on the recording medium is carried out; the operation for conveying the recording medium P and the operation for moving the carriage 3 in the primary direction while jetting ink from the recording head are alternately carried out. The leading edge of the recording medium P is lower in position than the light reflecting member 10 of each ink container 7. As the recording operation continues, the leading edge of the recording medium P eventually reaches a point at which the recording medium P begins to cover the light sensors 11 in the platen 5, as seen from the light reflecting member side. As the carriage 3 is moved in the primary scan direction when the leading edge of the recording medium P is at this point, the light emitted from the light emitting portion 8 is blocked by the recording medium P, even though the light is still reflected by the light reflecting member 10 of each ink container 7. Therefore, a signal (no detection signal), which is different from the one outputted by the light sensor 11 when the light from the light emitting portion 8 is received by the light sensor 11, is outputted.

The above described timing with which the conveyance roller, etc., begin to be driven, and the length of time it takes for the light from the light emitting portion 8 to begins to be prevented from entering the light sensors 11 in the platen 5, are measured by the timer with which the control system of the recording apparatus is provided. When the detected length of time is unduly long, the CPU of the control system determines that such problems that the recording medium P has failed to be normally fed, and/or that the recording medium P was improperly conveyed on the platen 5, being stuck on the platen 5 (recording medium P is not being conveyed). Then, the CPU drives a preset informing means, making it possible for a user to recognize the occurrence of paper jam in the ink jet recording apparatus, in the early stage of the occurrence.

Instead of designing the recording apparatus so that the timing with which the driving of the conveyance roller, etc., is started, the recording apparatus may be provided with a recording medium sensor, which may be positioned at any points in the recording medium conveyance path, other than the portion which corresponds to the platen 5. For example, a recording medium sensor may be located at the feeding end of a paper feeder cassette. Also in such a case, the occurrence of paper jam can be detected based on the information obtained by measuring, with the use of a timer or the like, the signals outputted by the sensors located in a point in the recording medium conveyance path other than the point corresponding to the platen 5, and the signals outputted by the light sensors 11 in the platen 5.

In the first embodiment, not only can the abovementioned occurrence of paper jam be detected, but also, whether or not the recording medium P is being conveyed askew can be detected. That is, if the recording medium P is conveyed askew as shown in FIG. 3(*b*), the light sensors 11 in the platen 5 are different in the point of time at which they begin to be covered by the recording medium P; the second light paths L2, through which the light from the light emitting portion 8 reaches the sensors 11K, 11Y, 11M, and 11C of the platen 5 by way of the light reflecting members 10 on the ink containers 7, are different in the timing with which they begin to be blocked.

Therefore, whether or not the recording medium is being conveyed askew can be determined by measuring the differences among the ink containers 7 in the length of time from when the recording medium P begins to be conveyed to when the light from the light emitting portion 8 begins to be prevented from reaching the light sensors 11; when the difference is unduly long, it is determined that the recording medium P is being conveyed askew. If the recording medium P is conveyed askew, the intended image is recorded askew on the recording medium. Therefore, if it is determined that the recording medium is being conveyed askew, the CPU drives the informing means to inform a user of the problem. Incidentally, the difference among the ink containers 7 in the abovementioned length of time, which occurs as the recording medium P is conveyed askew, is largest between the length of the time it takes for the light from the light emitting portion 8 to reach the light sensor 11Y and the length of time it takes for the light from the light emitting portion 8 to reach the light sensor 11C. Thus, the recording apparatus may be designed so that only the outputs from the light sensors 11Y and 11*c* are used for determining whether or not the recording medium P is being conveyed askew.

As described above, according to the first embodiment of the present invention, the recording apparatus is structured so that not only is the light from the only light emitting portion, with which the carriage 3 is provided, guided by the light reflecting member 10 of the ink container 7 to the light sensor 9 on the carriage 3, but also, to the light receiving portions 11 in the platen 5. Therefore, whether or not a specific ink container is in the recording apparatus (ink container bay), whether or not a specific ink container is proper in positioning, whether or not there is a paper jam in the recording apparatus, whether or not the recording medium is being conveyed askew, etc., can be determined with the employment of an inexpensive structural arrangement that uses only a single light emitting portion.

Embodiment 2

Next, referring to FIGS. 5 and 6, the second embodiment of the present invention will be described. The second embodiment is different from the first embodiment in that the multiple ink containers are different in the location in which the light reflecting member 10 used in the first embodiment is disposed. Otherwise, the first and second embodiments are the same in structure.

Figure 5:
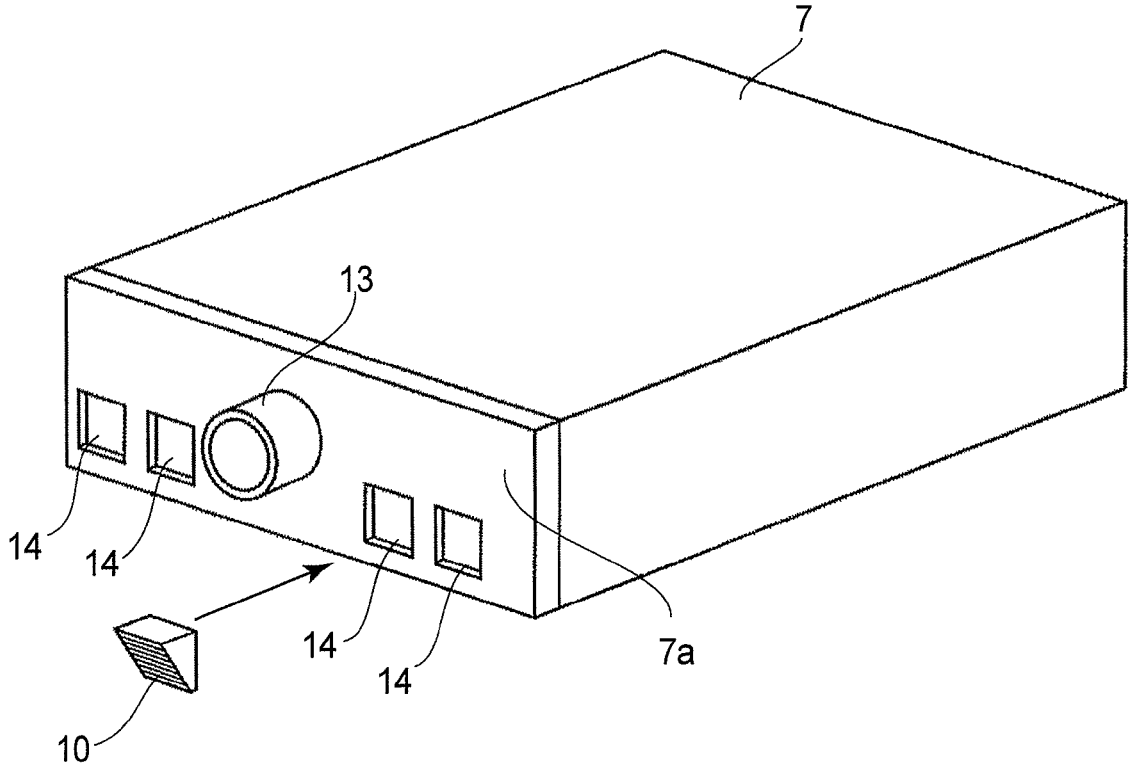
FIG. 5 is an external perspective view of the ink container for black ink in the second embodiment of the present invention.

Referring to FIG. 5, designated by a referential symbol 14 are recesses formed in the end surface 7*a* of each ink container 7 (in terms of the direction in which the ink container 7 is mounted in the recording apparatus) for the positioning of the light reflecting member 10. The abovementioned light reflecting member 10 is fitted in one of these recesses 14, and is fixed therein with the use of adhesive, ultrasonic welding, ordinary thermal welding, or the like. In this embodiment, in order to simplify the design and manufacture process of the ink containers 7, one of the end surfaces of the ink container 7 is provided with plural recesses, in which the light reflecting member 10 can be fitted. Then, in which recess of the each ink container the light reflecting member 10 is fitted is decided according to the type of the ink stored in the ink container.

Figure 6:
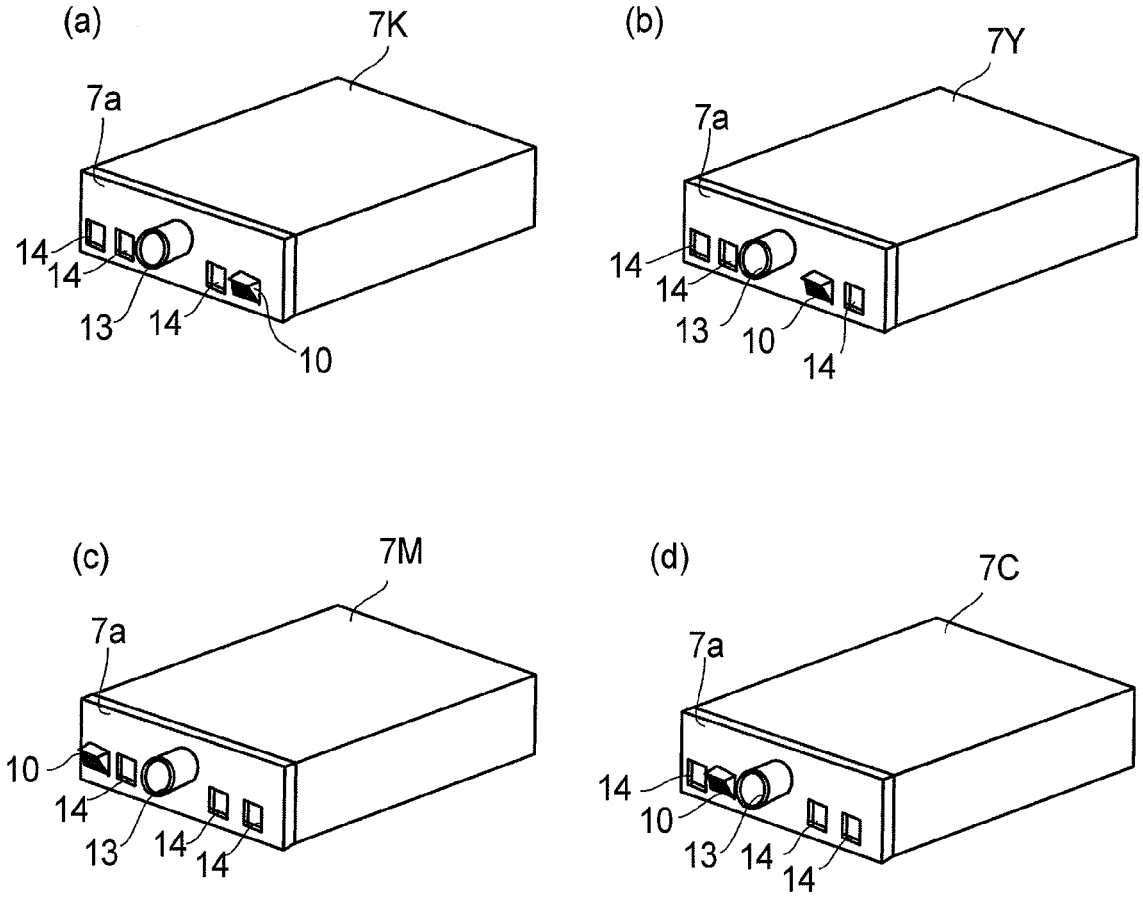
FIG. 6(*a*) is a perspective view of the ink container for yellow ink in the second embodiment.

FIG. 6 is an external perspective view of the ink container in this embodiment, showing the four ink containers which are virtually the same in structure as the one shown in FIG. 5, but, are different in the position of the light reflecting member 10. Referring to FIG. 6, the ink contains for black, yellow, magenta, and cyan inks are different in the position of the light reflecting member 10 on the end surface 7*a* of the ink container 7.

Referring to FIG. 6, in which recess on the end surface (in terms of in container insertion direction) of the ink container 7 the light reflecting member 10 is to be fitted is decided according to the type of the ink stored in the ink container 7, making it possible to detect whether or not a given ink container slot in the ink container bay is holding a wrong ink container (in terms of the ink therein) (error in mounting ink container). More concretely, the carriage 3 is moved in the primary scan direction while emitting light from the light emitting portion 8 of the carriage 3 toward the light reflecting members 10 of the ink containers 7K, 7Y, 7M, and 7C and detecting the point at which the carriage 3 is located when the light reception signal is outputted from each light sensor 9. Then, whether or not the ink container in a given ink container slot is correct one is determined by the detected position of the carriage 3.

That is, if a given ink container slot in the ink container bay is holding a wrong ink container 7, the point at which the carriage 8 is located when a light reception signal is outputted from the light sensor 9 is different from the point at which the carriage 8 is located when a light reception signal is outputted from the light sensor 9 of the correct ink container 7. Thus, whether or not the ink container in a given ink container slot in the ink container bay is a correct one can be determined by detecting in advance the point (referential point) at which the carriage 8 is present when a light reception signal is detected by the light sensor 9 of the correct ink container 7, and detecting whether or not the point at which the carriage 8 is located when a light reception signal is outputted by the light sensor 9 coincides with the abovementioned referential point for the carriage 3.

Further, the type of the ink in the ink container in each ink container slot can be determined by presetting the point in time (carriage position) at which a light reception signal is outputted from the light sensor 9 of each ink container 7 when the ink containers in the ink container bay are correct ones and are different in the type of the ink therein. That is, the type of the ink in each ink container 7 in the ink container bay can be determined by determining whether or not the point at which the carriage 8 is located when a light reception signal is outputted from the light sensor 9 coincides with the point at which the carriage 3 is located when a light reception signal is outputted from the light sensor 9 of an ink container which contains a specific ink and is in the correct slot.

As described above, according to this second embodiment, not only can the errors in the mounting of an ink container, but also, the type of the ink in the mounted ink container can be determined. Therefore, the recording apparatus can be drastically improved in usability by displaying these information (errors in mounting of ink container, type of ink in ink container, etc.) on a preset monitor or the like.

Also according to the second embodiment, the boxy shell of each ink container is provided with plural portions 14 (recesses, for example), in which the light reflecting member 10 is fitted, and the number of which corresponds to the number of the inks, different in type (color, for example), used by the recording apparatus. Further, the plural portions 14 are different in position. Therefore, it is possible to use one type of boxy shell for all of the plural ink containers.

Embodiment 3

Next, referring to FIGS. 7 and 8, the third embodiment of the present invention will be described.

Figure 7:
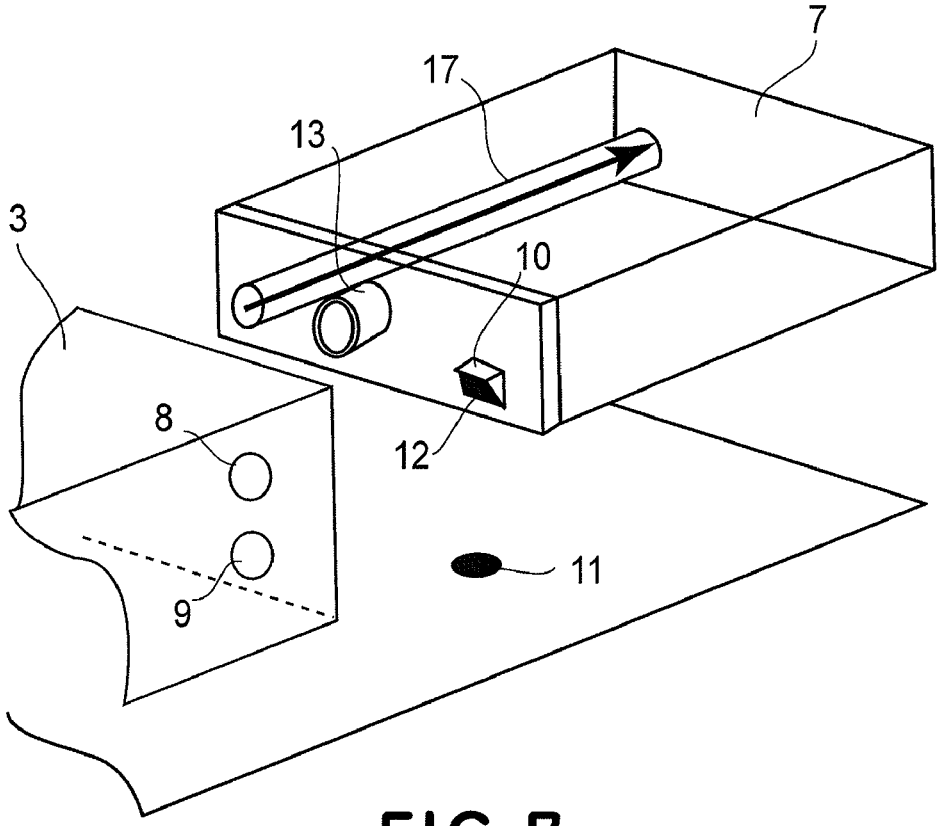
FIG. 7 is an external perspective view of the ink container in the third embodiment.

FIG. 7 is an external perspective view of one of the ink containers in the third embodiment. Designated in the drawing by a referential symbol 17 is a light guide disposed in the ink container 7. The light guide 17 is formed of resin. One of the lengthwise ends of the light guide 7 is exposed at the front end surface 7*a* of the ink container 7, in terms of the ink container insertion direction, whereas the other end is exposed at the rear end surface (front end surface) of the ink container 7. The light guide 17 has the function of guiding the light emitted from the light emitting portion 8, to the rear end surface of the ink container 7, when the light emitting portion 8 of the carriage 3 is opposing the front end of the light guide 17. This function of the light guide 17 makes it possible to optically display outward the information regarding the state of the ink container 7.

Figure 8:
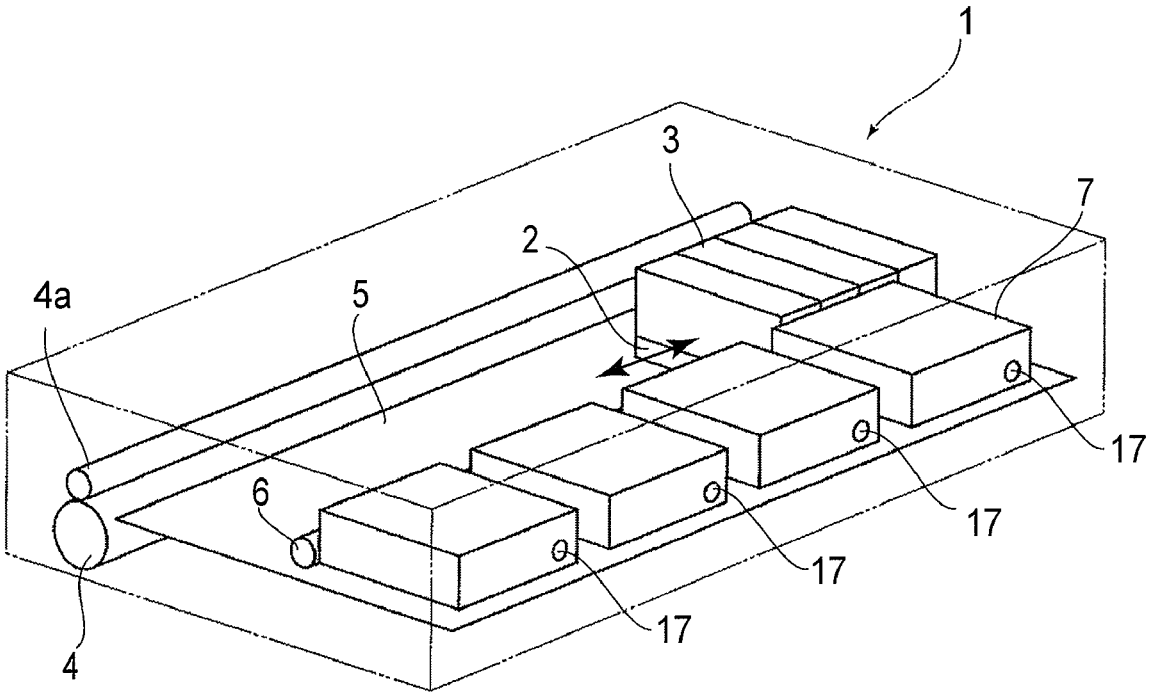
FIG. 8 is a perspective phantom view of the ink container in the third embodiment, showing the properly mounted ink container.

FIG. 8 is a schematic perspective phantom view of the ink jet recording apparatus, in which the ink containers shown in FIG. 7 are in the proper positions. As shown in the drawing, one end of the light guide 17 in each ink container 7 is visible from the front side of the ink jet recording apparatus 1. If it is determined by the function of the ink remainder amount detecting means that one of the ink containers is out of ink, or it is determined that there is an improperly mounted ink containers in the ink container bay, the light is emitted from the light emitting portion 8 toward the light guide 17 of this ink container 7. The light from the light emitting portion 8 transmits through the light guide 17 in the ink container, as indicated by an arrow mark in the drawing, becoming visible from the front side of the recording apparatus; the ink container appears as if it is emitting light. Therefore, a user can visually determine whether or not a specific ink container is in the recording apparatus (ink container bay), or whether or not a specific ink container is proper in its positioning in the recording apparatus, drastically improving the recording apparatus in usability and interestingness. It is also possible to adjust the timing with which the light emitting portion is turned on, and the number of the light emitting portions which can be simultaneously turned on. Further, if the occurrence of paper jam such as the above described one is detected, or if it is detected that the recording medium is being conveyed askew, it is possible to warn a user of the occurrence of the above described problems by flickeringly illuminating the light guides of all the ink containers by moving the carriage 3 in the primary scan direction once, or multiple times.

Embodiment 4

Next, referring to FIGS. 9-15, the fourth embodiment of the present invention will be described.

In the first to third embodiments described above, the light from the light emitting portion 8 on the carriage 3 is reflected by the light reflecting member 10 attached to one of the end surfaces of the ink container 7, so that the light are directed toward the light sensor 9 on the carriage 3 and the light sensor 11 in the platen 5, at the same time. In this embodiment, or the fourth embodiment, each ink container 7 is provided with a light reflecting member 20 for reflecting the light from the light emitting portion 8. This light reflecting member 20 is variable in angle so that its angle can be switched between the angle at which it guides the light from the light emitting portion 8, toward the light sensor 9, and the angle at which it guides the light toward the light sensor 11.

Figure 9:
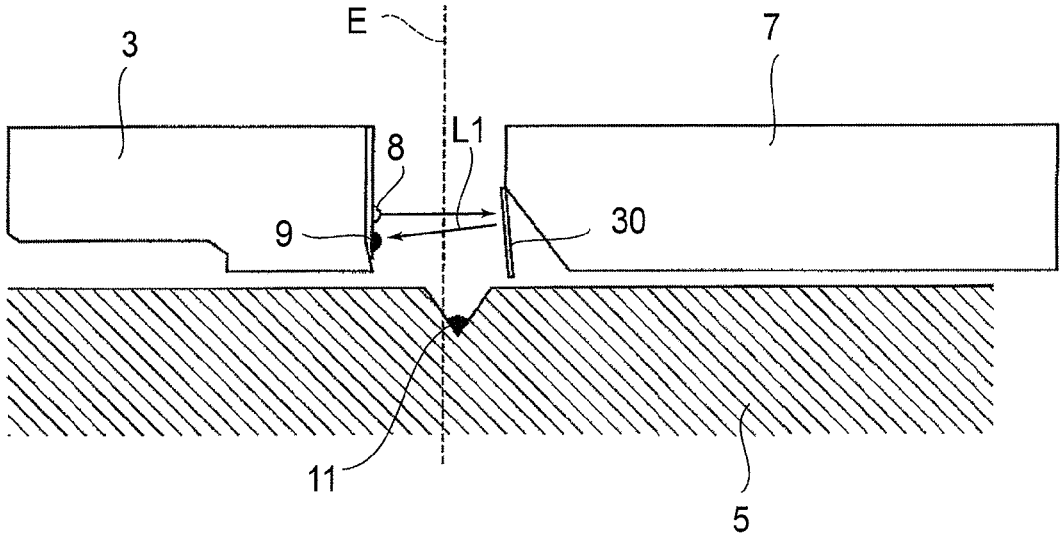
FIG. 9(*a*) is a schematic drawing showing the first light path in the fourth embodiment of the present invention.
Figure 9:
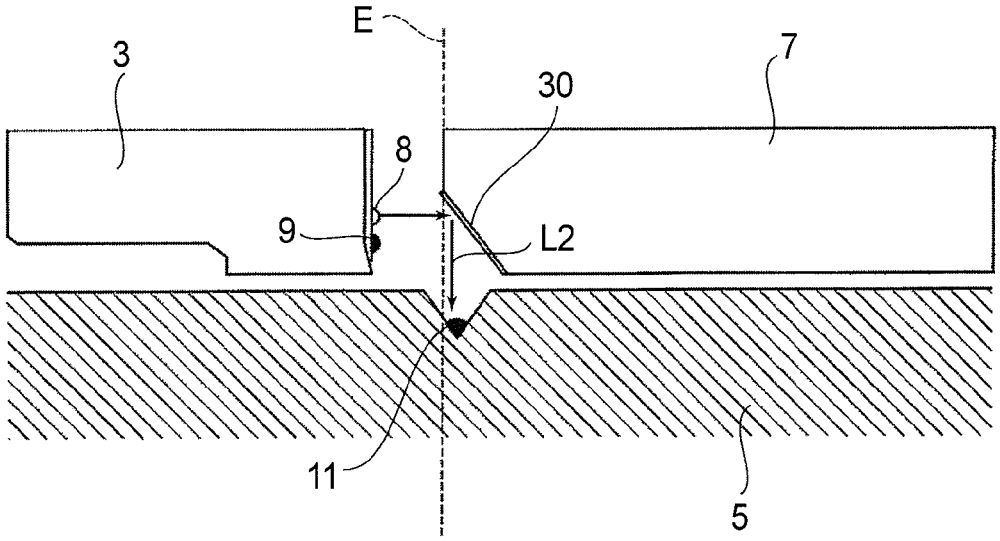

FIG. 9 is a schematic sectional view of the light reflecting member 20 and its adjacencies, in the fourth embodiment, showing the function of the light reflecting member 20.

FIG. 9(*a*) shows the ink container 7 which is being inserted into the ink container bay of the ink jet recording apparatus. If the carriage 3 is moved in the primary scan direction during the insertion of the ink container 7 into the apparatus, the light emitted from the light emitting portion 8 travels to the light reflecting member 20 of the ink container 7 as indicated by an arrow mark in the drawing, and enters the light sensor 9 on the carriage 3, following the first light path L1.

As the ink container 7 is inserted deep enough for the leading end of the ink container 7 reaches the point E (deepest point) in the ink container bay of the ink jet recording apparatus, the light reflecting member 20 of the ink container 7 is tilted as shown in FIG. 9(*b*). As a result, the light emitted from the light emitting portion 8 on the carriage 3 enters the light sensor 11 in the platen 5, following the second light path L2 after traveling to the light reflecting member 20, as indicated by an arrow mark in the drawing.

As described above, during the insertion of the ink container 7, the light emitted from the light emitting portion 8 of the carriage 3 follows the first light path L1 and is received by the light sensor 9 of the carriage 3, as indicated by the arrow mark in FIG. 9(*a*), whereas after the completion of the mounting of the ink container 7, the light from the light emitting portion 8 follows the second light path L2 and is received by the light sensor 11 in the platen 5. Thus, if a no-light-reception signal (OFF signal) is outputted from the light sensor 11 even though a light reception signal (ON signal) was outputted from the light sensor 9 during the insertion of the ink container 7, the CPU determines that there is an improperly mounted ink container 7 in the apparatus.

On the other hand, when there is no ink container in any of the ink container slot in the ink container bay of the ink jet recording apparatus, neither the light sensors 9 nor 11 outputs a light reception signal. Therefore, the CPU determines that this ink container slot is empty; the ink container 7 which is to be mounted into this ink container slot, is not in the slot.

Further, which ink container in the recording apparatus is an improperly mounted ink container, or which ink container is not in the recording apparatus, can be determined by using the information regarding the position of the carriage 3 and the signals outputted by the light sensors 9 and 11.

Also in this embodiment, the operation, such as the above described one, for detecting the state (position, attitude, etc.) of the ink container in the ink container bay can be carried out at any point in time as long as the carriage can be moved in the primary scan direction.

Further, also in this fourth embodiment, recording medium conveyance errors, such as paper jam or angular deviation of the recording medium, can be detected as they can in the first to third embodiments.

That is, as the light sensor 11 is covered by recording medium when the ink container 7 in the ink container bay is correct in position and attitude, that is, when the leading end of the ink container 7 is at the point E, and the light from the light emitting portion 8 reaches the light sensor 11, following the second light path L2, as shown in FIG. 9(*b*), a signal (OFF signal) different from the light reception signal is outputted from the light sensor 11. Therefore, whether or not paper jam has occurred can be determined by measuring the length of time from when the recording medium P begins to be conveyed to when the light sensor 11 begins to be covered by the recording medium P; when the length of time is unduly long, it is determined that paper jam has occurred.

Further, whether or not the recording medium is being conveyed askew can be determined by measuring the difference among the multiple light sensors 11Y, 11M, 11K, and 11C in the length of time from when the recording medium P begins to be conveyed to when the light which is entering the light sensors begins to be blocked; when the difference is unduly large, it is determined that the recording medium P is being conveyed askew.

At this point in time, the structure of the ink container 7 in the fourth embodiment of the present invention will be concretely described with reference to FIGS. 10-12.

Figure 10:
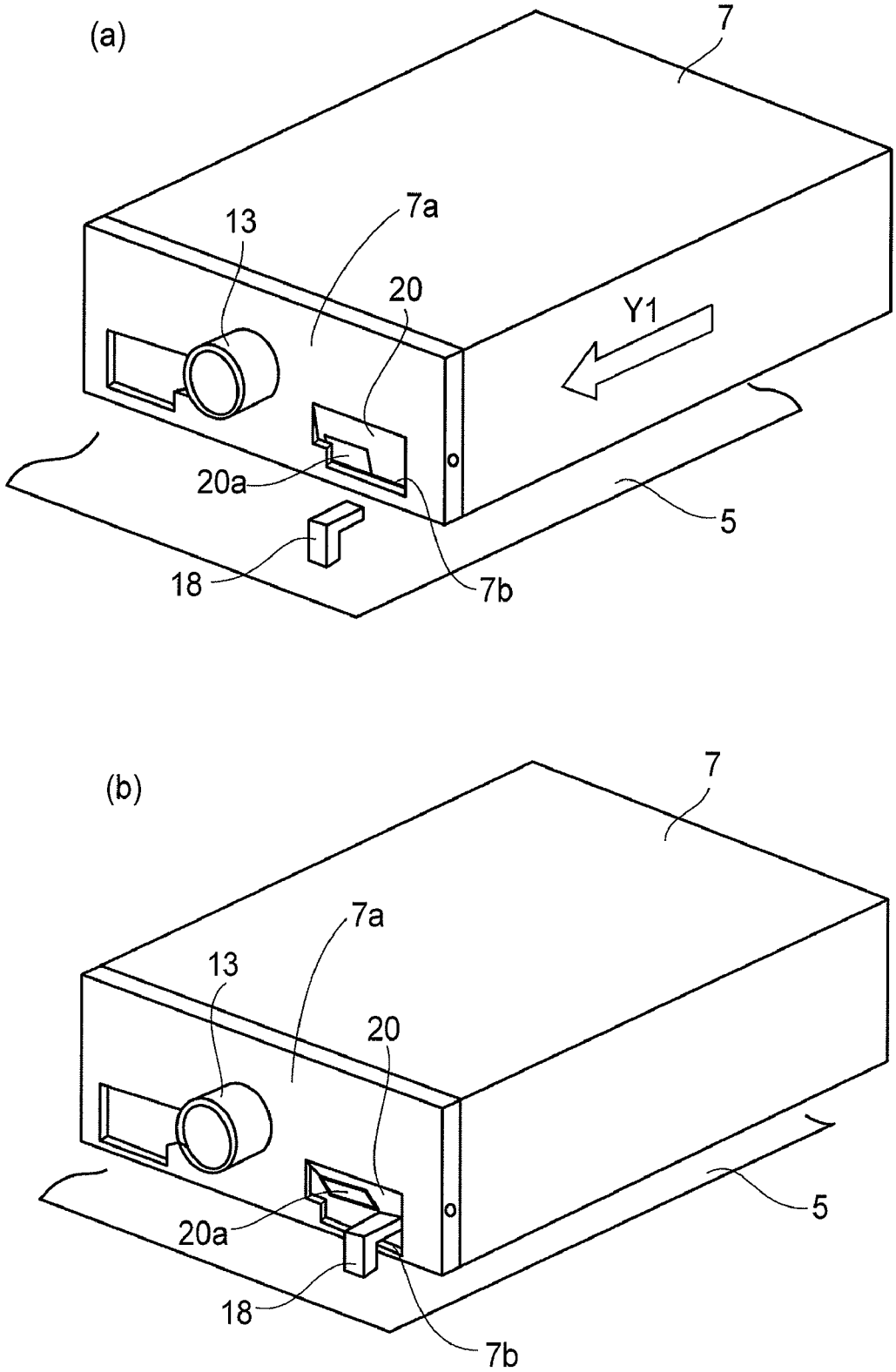
FIG. 10(*a*) is a perspective view of the ink container in the fourth embodiment, which is being mounted.

Referring to FIGS. 10(*a*) and 10(*b*), the ink container bay of the recording apparatus 1 is provided with a projection 18 for poking the light reflecting member 20, which angularly displaces the light reflecting member 20 of the ink container 7; as the ink container is inserted into the proper position in the ink container bay, the light reflecting member 20 comes into contact with the projection 18 and pushed by the projection 18. FIG. 10(*a*) shows the ink container 7, which is being inserted into the recording apparatus. The end wall 7*a* of the ink container, in terms of the ink container insertion direction, is provided with an opening 7*b*. The light reflecting member 20 is hinged to the ink container 7 by the top edge so that the light reflecting member 20 is rotatable about the hinge to open or close this opening 7*b*. Prior to the mounting of the ink container into the recording apparatus, the light reflecting member 20 is kept pressured in the direction to keep the opening 7*b* closed. Thus, before the mounting of the ink container into the recording apparatus, the light reflecting member 20 remains roughly vertical relative to the ink container insertion direction. During the initial stage of the insertion of the ink container, the light emitted from the light emitting portion 8 of the carriage 3 is reflected by the reflective surface 20*a* of the light reflecting member 20, which is remaining vertical, and reaches the light sensor 9 of the carriage 3, following the first light path L1 as shown in FIG. 9(*a*).

FIGS. 9(*b*) and 10(*b*) show the ink container 7, which is properly positioned in the recording apparatus (ink container bay), that is, the ink container 7, the leading end of which is at the point E (deepest point). While the ink container 7 is inserted into the position shown in these drawings, the light reflecting member 20 comes into contact with the projection 8 for angularly displacing the light reflecting member 20, and then, is pushed by the projection 18, being thereby tilted by the projection 18. As a result, the light reflecting member 20 guides the light emitted light emitting portion 8 of the carriage 3, to the light sensor 11 on the platen 5. That is, the path of the light from the light emitting portion 8 changes from the first light path L1 to the second light path L2 shown in FIG. 9(*b*).

Figure 11:
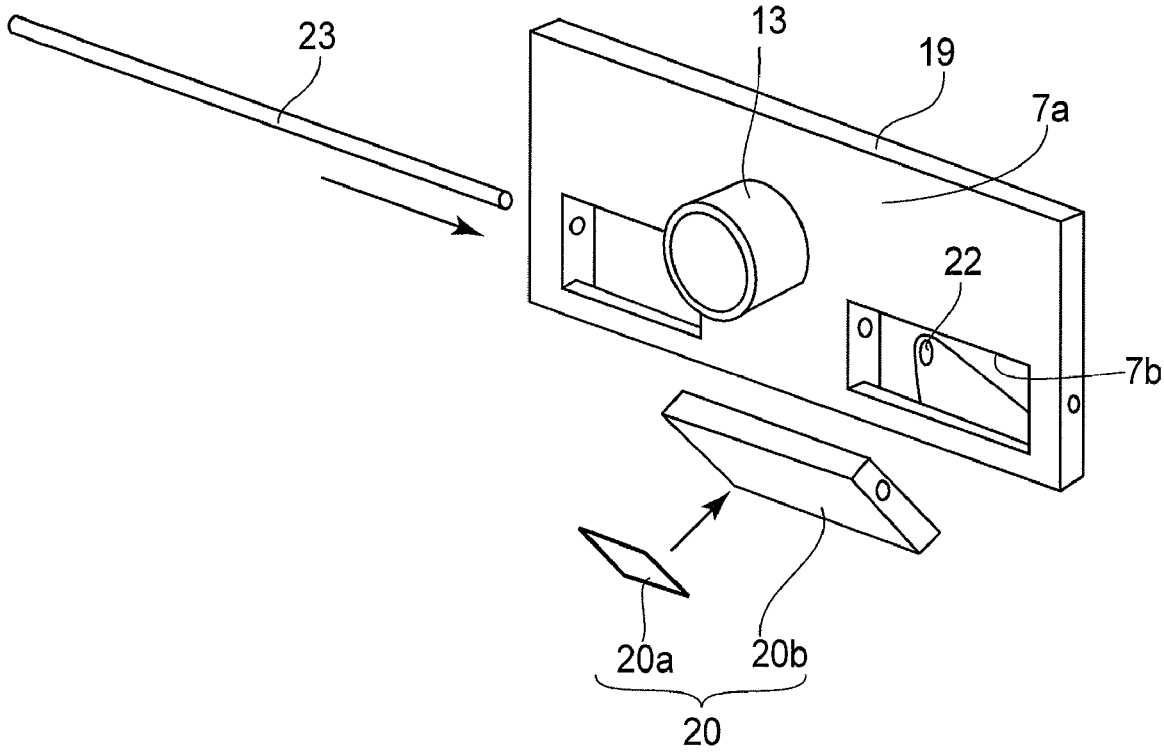
FIG. 11 is an exploded perspective view of the light reflecting member and adjacent components thereof, showing the structural arrangement for attaching the light reflecting member.

FIG. 11 is an exploded perspective view of the light reflecting member 20 and the adjacencies thereof, shown in FIG. 10, showing the structure for attaching the light reflecting member 20 to the ink container.

Referring to FIG. 11, designated by a referential symbol 19 is a component on the ink container side, which makes up the end wall 7*a* of the ink container 7, which is on the downstream side in terms of the ink container insertion direction. This component 19 has a spout 13, which is connected to the recording head of the ink jet recording apparatus. Designated by a referential symbol 20 is a light reflecting member, which in made up of a flat substrate 20*b* and a reflective member 20*a* (which hereafter will be referred to actual light reflecting member). The actual light reflective member 20*a* is pasted to the flat substrate 20*b*. The actual light reflecting member 20*a* has a mirror-like surface, which reflects the light emitted from the light emitting portion 8 of the carriage 3. The substrate 20*b* and component 19 are provided with a through hole, through which a connective pin 23 is put. Designated by a referential symbol 22 is a pressure application spring, which is more or less in the form of a coil spring. The connective pin 23 is also put through the coiled portion of the spring 22. This spring 22 is used for keeping the light reflecting member 20 pressed upon the inward surface of the component 19, which constitutes one of the inward surface of the ink container 7.

The substrate 20*b* and pressure application spring 22 are attached to the component 19 with the use of the connective pin 23. When the ink container is not in the recording apparatus, the actual light reflecting member 20*a* is kept roughly vertical by the pressure application spring 22, whereas the ink container is in the proper position in the recording apparatus, the actual light reflecting member 20*a* remains tilted by being pressed by the aforementioned projection 18 for pushing the light reflecting member 20.

As described above, the ink container 7 in the fourth embodiment can efficiently switch the path of the light from the light emitting portion 8 of the carriage 3, between the first and second light paths, while being relatively simple in structure.

Figure 12:
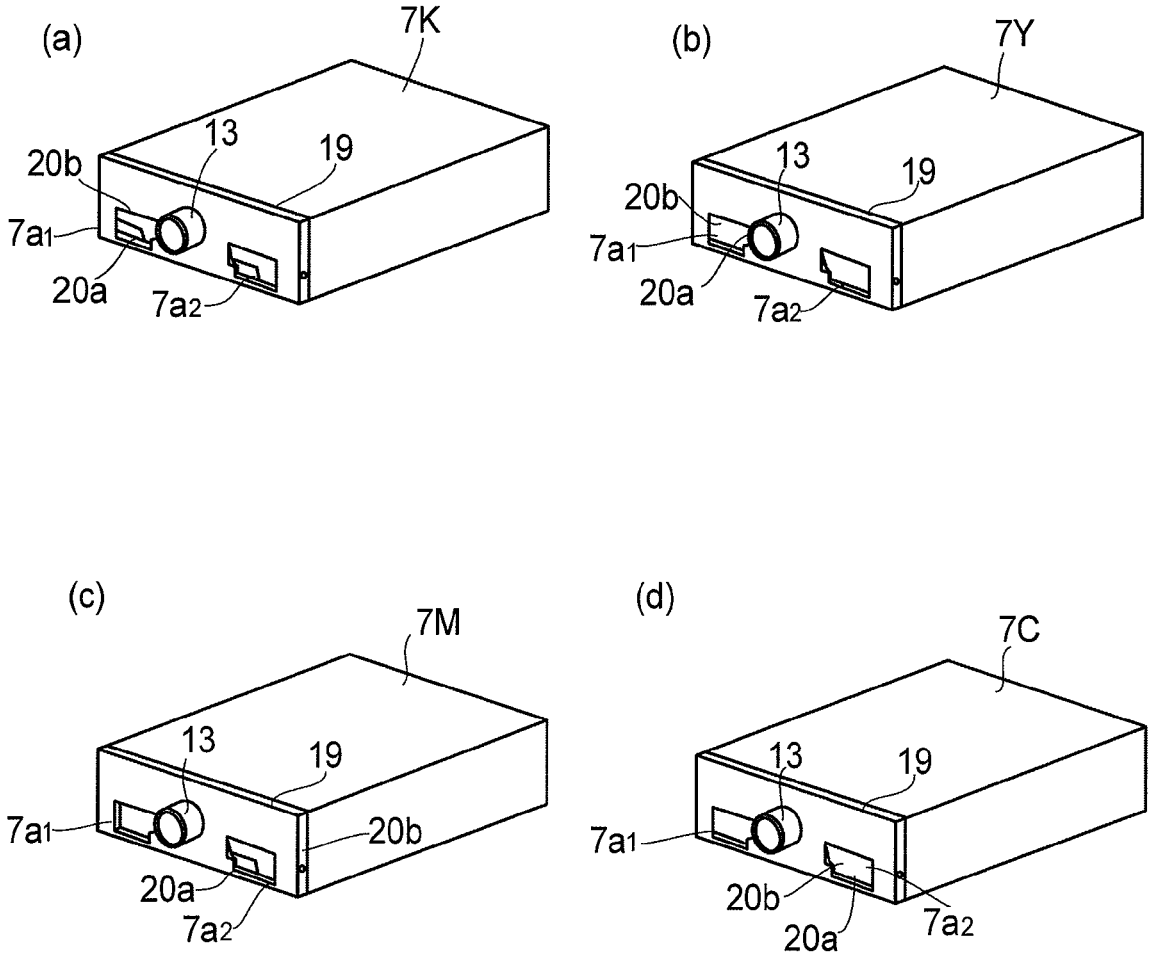
FIG. 12(*a*) is a perspective view of the ink container for black ink in the fourth embodiment of the present invention.

Further, referring to FIGS. 12(*a*)-12(*d*), the ink container 7 in the fourth embodiment can also be modified in structure so that the portion of the leading end wall 7*a* of the ink container 7 (in terms of ink container insertion direction), to which the light reflecting member 20 is attached, can be changed in position according to the type of the ink stored in the ink container 7.

For example, when manufacturing four types of ink container, which are different in the color of the ink to be stored therein, first, four identical ink container shells, the spouted component 19 of which has two openings 7*a*1 and 7*a*2, are prepared. In the case of the two ink container shells (7K) and (7Y), the substrate 20*b* is attached to the opening 7*a*1, as shown in FIGS. 12(*a*) and 12(*b*), respectively, whereas in the case of two ink container shells (7M) and (7C), the substrate

20*b* is attached to the other opening 7*a*2 as shown in FIGS. 12(*c*) and 12(*d*), respectively. Then, the actual light reflecting member 20*a* is attached to the substrate 20*b* attached to the opening 7*a*1 of the ink container shell (7K) and the substrate 20*b* attached to the opening 7*a*1 of the ink container shell (7M). However, the ink container shells (7K) and (7Y) are rendered different in the portion of the substrate 20*b*, to which the actual light reflecting member 20*a* is attached. For example, in the case of the ink container for black ink, shown in FIG. 20(*a*), the actual light reflecting member 20*a* is pasted to the left side of the substrate 20*b*, whereas in the case of the ink container for yellow ink, shown in FIG. 20(*b*), the actual light reflecting member 20*a* is pasted to the right-hand side of the substrate 20*b*. In other words, this embodiment makes it possible for the single type of boxy ink container shell to be used for the four ink containers 7K, 7Y, 7M and 7C, which are different in the type of the ink to be stored therein, by varying the four ink containers 7K, 7Y, 7M, and 7C in the portion of the substrate 20 to which the actual light reflecting member 20*a* is attached. Therefore, it is possible to inexpensively manufacture the ink containers.

Further, the erroneous insertion of the ink container can be detected, as in the first embodiment, by varying the ink containers different in the type of the inks stored therein, in the position of the reflective surface 20*a*, according to the type of the ink stored therein. More specifically, the carriage 3 is moved in the primary scan direction so that the light from the light emitting portion 8 is projected onto the reflective surface 20*a* of each of the ink containers 7K, 7Y, 7M, and 7*c*. Then, the point at which the carriage 3 was located when the light from the light emitting portion 8 was received by the light sensor 9 of the carriage 3 is examined. If the ink container in a given ink container slot is wrong in the color of the ink therein, the point at which the light from the light emitting portion 8 is received by the light sensor 9 of the carriage 3 is different from the preset point at which the light is to be received by the light sensor 9 when the ink container is the correct one, making it therefore possible to detect the erroneous mounting of the ink container. It is also possible to determine the type of the ink container in the apparatus, based on the information regarding the point at which the carriage 3 is located when a reception signal is outputted by the light sensor 9.

Embodiment 5

Next, referring to FIG. 13, the fifth embodiment of the present invention will be described.

In this embodiment, the light from the light emitting portion 8 on the carriage 3 is guided to the light sensor 9 or 11 by switching the angle of the light reflecting member 20 as in the fourth embodiment described above. However, this embodiment is different from the fourth embodiment in the structural arrangement for changing the angle of the light reflecting member 20. Incidentally, the structural components in this embodiment, which are identical or equivalent to those in the fourth embodiment are given the same referential symbols as those given for the description of the fourth embodiment, and will not be described in detail.

Figure 13:
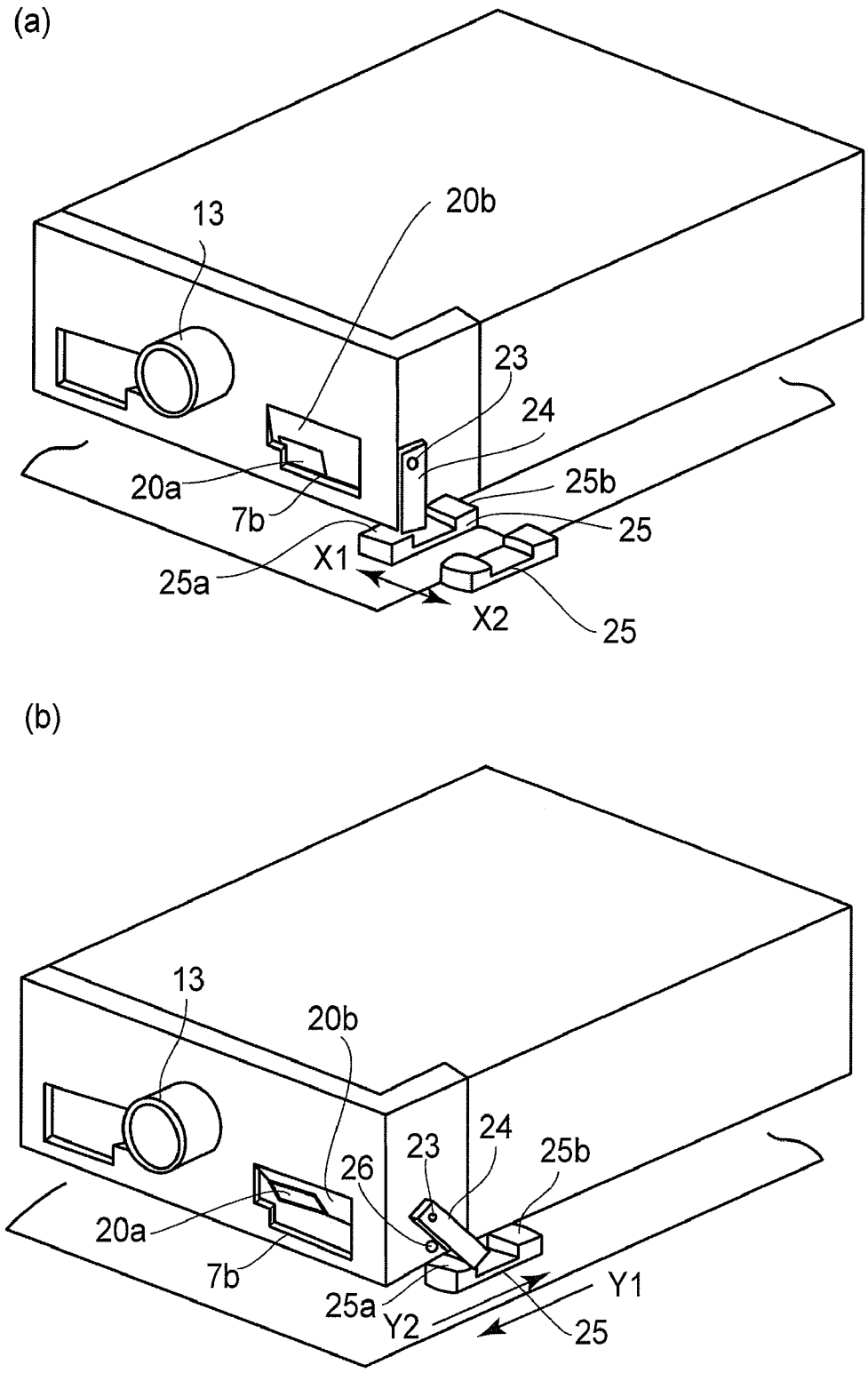
FIG. 13(*a*) is a perspective view of the ink container, and the slider having moved in the direction X1 from the standby position, in the fifth embodiment of the present invention.
Figure 14:
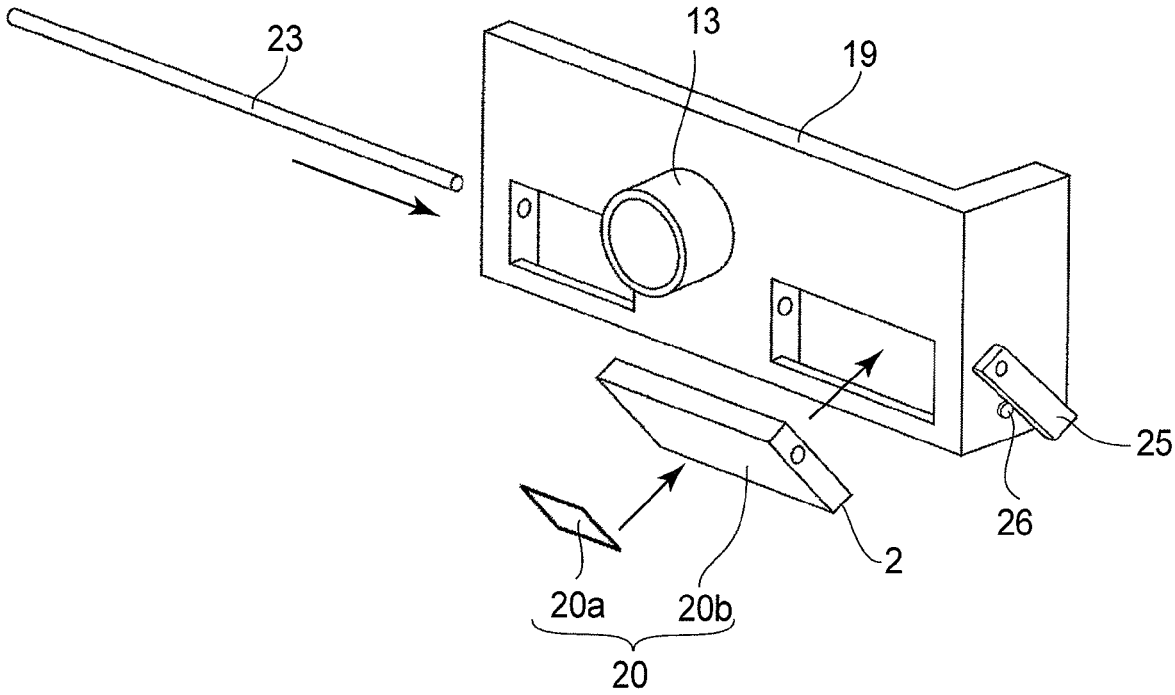
FIG. 14 is an exploded perspective view of the light reflecting member and the components for attaching the light reflecting member to the ink container, in the fifth embodiment, showing the structure thereof.

FIG. 13(*a*) shows the ink container 7 after the completion of its insertion into the ink jet recording apparatus. In the drawing, designated by a referential symbol 24 is a lever for changing the angle of the light reflecting member 20. This lever 24 is rigidly attached to one end of the connective pin 23 which supports the substrate 20*b* of the light reflecting member 20. In this embodiment, the substrate 20*b* is also rigidly attached to the connective pin 23. Therefore, as the lever 24 rotates with the connector pin 23, the substrate 20*b* rotates with the connector pin 23. Incidentally, normally, the substrate 20*b* is kept in the position (initial position) in which it is in contact with the frontal component of the ink container, by its own weight.

Designated by a referential symbol 25 is a slider for rotating the lever 24 to change the angle of the lever 24. The slider 25 is a part of the main assembly of the recording apparatus. It has projections 25*a* and 25*b*, which are located at its front and rear ends, respectively, in terms of the ink container insertion direction. Not only is this slider 25 is movable in the directions indicated by arrow marks X1 and X2 in FIG. 13(*a*), but also, in the directions indicated by arrow marks Y1 and Y2 in FIG. 13(*b*).

Until the ink container 7 is moved into its correct position in the recording apparatus, the slider 25 is kept in its standby position indicated by a single-dot chain line in FIG. 13(*a*). Designated by a referential symbol 26 is a projection with which the ink container 7 is provided. The projection 26 is for keeping the lever 24 of the ink container 7 in two different attitudes: roughly vertical or tilted at a preset angle.

Until the ink container 7 structured as described above is inserted into the proper position in the ink container bay of the ink jet recording apparatus 1, the lever 24 is retained in the standby position shown in FIG. 13(*a*). The slider 25 remains in the position indicated by a dotted line. While the lever 24 and slider 25 are in the above described positions, the reflective surface 20*a* of the light reflecting member 20 is kept roughly vertical. Therefore, the light from the light emitting portion 8 of the carriage 3 is reflected toward the light receiving portion 9 of the carriage 3. As the slider 25 is moved in the direction indicated by the arrow mark X1 in FIG. 13(*a*), the projections 25*a* and 25*b* of the slider 25 are positioned on the front and rear sides, respectively, of the bottom end of the lever 24. Thereafter, the slider 25 is moved in the direction indicated by the arrow marks Y2 in FIG. 13(*b*). As the slider 25 is moved, the lever 24 is rotated, riding over the projection 26, by being pushed by the projection 25*a* of the slider 25. After riding over the projection 26, the lever 24 is retained by the projection 26, on the opposite side of the projection 26 from the standby position. The rotation of the lever 24 causes the actual light reflecting member 20*a* to rotate. Then, as the lever 24 is retained by the projection 26, the light reflecting member 20 is retained at a preset angle, which is such an angle that causes the actual light reflecting member 20*a* to reflect the light from the light emitting portion 8 of the carriage 3, toward the light sensor 11 of the platen 5.

During the operation for replacing the ink container 7, the above described operation sequence occurs in reverse. That is, the slider 25 is moved in the direction Y1 in FIG. 13(*b*), rotating in verse the lever 24. As the lever 24 is rotated in reverse, it rides over the projection 26. This reverse rotation of the lever 24 causes the light reflecting member 20 to rotate back into the initial position. As a result, the angle of the actual light reflecting member 20*a* changes to such an angle that causes the actual light reflecting member 20*a* to reflect the light from the light emitting portion 8 of the carriage 3, toward the light sensor 9 of the carriage 3. The slider 25 is moved in the reverse direction, that is, the direction indicated by the arrow mark X2 in FIG. 13(*a*), returning to the standby position in which it does not interfere with the lever 24. When the slider 25 is in the standby position, a user is allowed to extract the ink container 7 from the ink container bay of the ink jet recording apparatus 1, and mount a brand-new ink container.

Also in this (fifth) embodiment, multiple ink containers, which are different in the type of the ink therein, can be made different in the area of an ink container, to which the light reflecting member 20 is attached.

INDUSTRIAL APPLICABILITY

As described hereinabove, according to the present invention, it is possible to provide an ink jet recording apparatus and an ink container, which are low in cost and simple in structure, and yet, are capable of detecting the occurrences of an error in the mounting of an ink container, an error in the recording medium conveyance, and the like.

While the invention has been described with reference to the structures disclosed herein, it is not confined to the details set forth, and this application is intended to cover such modifications or changes as may come within the purposes of the improvements or the scope of the following claims.

The invention claimed is:

1. A recording apparatus comprising:

a supporting member for supporting a recording material which is being fed:

a carriage for scanningly moving a recording head in a direction crossing with a feeding direction of the recording material;

a light emitting portion for emitting light;

a liquid container having light reflection means for reflecting light from the light emitting portion;

a first light receiving portion for receiving the light reflected by the light reflection means provided on the liquid container;

a second light receiving portion, provided in said supporting member, for receiving the light reflected by the light reflection means; and discriminating means for discriminating a mounting state of the liquid container in accordance with an output signal of said first light receiving portion and for discriminating a feeding state of the recording material in accordance with an output signal of said second light receiving portion.

2. An apparatus according to claim 1, further comprising a mounting portion to which said liquid container is mountable.

3. An apparatus according to claim 2, wherein said apparatus comprises a plurality of such mounting portions to each of which the liquid container is detachably mountable and a plurality of such second light receiving portions corresponding to a plurality of such recording heads.

4. An apparatus according to claim 3, wherein said discriminating means discriminates the mounting states of the liquid containers at said mounting portions in accordance with the output signal of said first light receiving portion.

5. An apparatus according to claim 4, wherein said discriminating means discriminates whether or not the liquid containers are mounted properly to respective mounting portions, in accordance with the output signals of said first light receiving portion and said second light receiving portion.

6. An apparatus according to claim 4, wherein said mounting portions are arranged in the scanning direction of said carriage, and said discriminating means discriminates a mounting portions to which the liquid container is not mounted, on the basis of an output signal of said first light receiving portion and positional information of said carriage with respect to the scanning direction of said carriage.

7. An apparatus according to claim 3, wherein said light reflection means is disposed at a position peculiar to a kind of liquid contained in said liquid container, wherein said mounting portions are arranged in the scanning direction of said carriage, and said discriminating means discriminates a mounting portion to which the liquid container is not mounted and a kind of ink in a mounted one of the liquid containers, on the basis of an output signal of said first light receiving portion and positional information of said carriage with respect to the scanning direction of said carriage.

8. An apparatus according to claim 3, wherein said discriminating means discriminates a feeding state of the recording material on the basis of time periods from start of recording material feeding operation to outputs of non-light-receiving signals of said second light receiving portions.

* * * * *